United States Patent [19]

van Rijswijck

[11] 4,227,034

[45] Oct. 7, 1980

[54] EARTH GROUND ASSEMBLY INCLUDING AN ELECTRODE AND ROD MEANS WHICH MAY BE DRIVEN INTO THE GROUND

[76] Inventor: Bernard P. J. M. van Rijswijck, 16, Eikenlaan, St. Michielsgestel, Netherlands

[21] Appl. No.: 908,500

[22] Filed: May 22, 1978

[30] Foreign Application Priority Data

May 20, 1977 [NL] Netherlands ..... 7705571

[51] Int. Cl.[3] ..... H01R 4/66

[52] U.S. Cl. ..... 174/7

[58] Field of Search ..... 174/6, 7; 339/14 R, 339/14 L; 52/155, 156, 165, 166; 175/22; 405/244

[56] References Cited

U.S. PATENT DOCUMENTS

| | | | |
|---|---|---|---|
| 642,169 | 1/1900 | Stokes | 174/7 |
| 1,154,099 | 9/1915 | Curry | 174/7 |
| 1,437,613 | 12/1922 | Petersen | 174/7 |
| 3,060,257 | 10/1962 | Spurgeon | 174/7 |
| 3,080,631 | 3/1963 | Ruhlman | 174/DIG. 12 |
| 3,548,069 | 12/1970 | Watanabe | 174/7 |

FOREIGN PATENT DOCUMENTS

| | | | |
|---|---|---|---|
| 569907 | 7/1961 | Belgium | 174/7 |
| 51-50452 | 4/1976 | Japan | 174/7 |
| 7508718 | 1/1977 | Netherlands | 174/7 |
| 124102 | 3/1919 | United Kingdom | 174/7 |

*Primary Examiner*—Laramie E. Askin

*Attorney, Agent, or Firm*—Karl W. Flocks

[57] ABSTRACT

An earth ground assembly including an electrode and rod member which may be driven into the ground comprising at least one metal clamping wire which is secured to the lower end of the rod member and which is wound helically, with a number of windings, clampingly around the lower part of the earth electrode, and of which the pitch is greater than the diameter of the earth electrode.

3 Claims, 10 Drawing Figures

Figure 1:
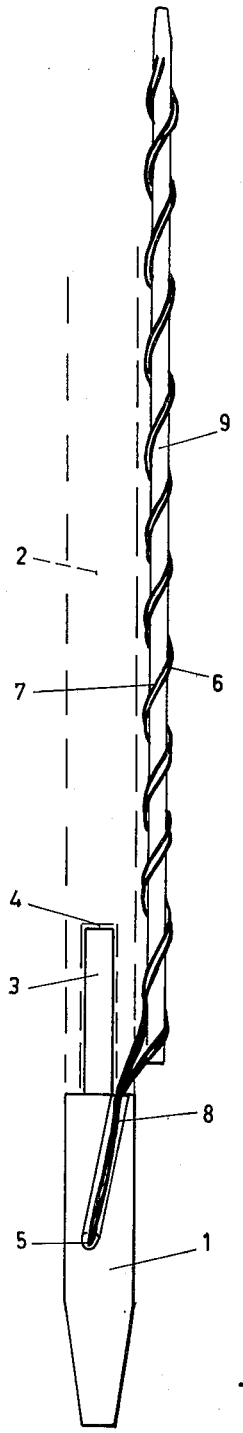

EARTH GROUND ASSEMBLY INCLUDING AN ELECTRODE AND ROD MEANS WHICH MAY BE DRIVEN INTO THE GROUND

The invention relates to an earth ground assembly comprising in combination an earth electrode with a rod which may be driven into the ground. This device has the advantage that the percussions for driving the rod into the ground are exerted on the rod, whereas the earth electrode is pulled into the ground by this rod. Thus the earth electrode runs no or almost no risk of being damaged when being brought into the ground.

This is realized with the device according to the invention in that it consists of at least one metal clamping wire which is secured to the lower end of the rod and which is wound helically, with a number of windings, clampingly around the lower end of the earth electrode, and of which the pitch is greater than the diameter of the earth electrode. By this embodiment the device has the advantage that it can be connected easily and firmly with the lower end of the earth electrode.

If desired so, the rod may be hollow and consist of a number of sections which can be coupled to each other. The lower end of the rod is preferably a loose part which can be coupled to the rest of the rod.

In this device the lower part of the rod may be provided with a hole, through which the or each helically wound wire is put, the two ends of the wire or each wire protruding from the hole being clampingly wound around the lower end of the earth electrode and these two ends being wound in the same direction with the same pitch.

According to another embodiment of this device, a rod portion is provided parallel to the lower part of the rod proper, around which rod portion grips a part of the helically wound clamping wire, whereas the remaining part of this clamping wire grips around the lower end of the earth electrode.

The rod portion may be secured to the rod proper by means of welding.

The lower part of the rod may consist of a tube, of which the lower end is closed by a plug with a point, to which plug a rod is secured, around which grips a part of the helically wound clamping wire, whereas the remaining part of the clamping wire grips around the lower end of the earth electrode. Instead of securing the rod to the plug by means of welding, the plug may also be provided with a short tube provided in the tube, in which short tube is secured the lower end of a metal rod, e.g. by means of rolling or swaging.

The device may also be carried out in such a way that the lower end of the lower part of the rod and at least the lower part of the earth electrode are provided with a screen closed at its under end, which screen is provided and carried out in such a way that it prevents the rolling of the clamping wire on the lower end of the earth electrode during the insertion into the ground and the displacement of the ground.

A favourable embodiment of a device protected by a screen against the rolling of the clamping wire is characterizeed in that the screen is in the form of a protective tube, which is provided at the lower end of the rod, in which tube is provided a part of the clamping wire with an end part of the earth electrode, which clamping wire with the end part of the earth electrode is secured in the protective tube by means of dented tube wall sections. In this embodiment the protected tube also serves for securing the earth electrode to the lower part of the rod. The protective tube may be secured to the lower part of the rod by means of welding or it may form one single piece therewith.

In order to bring the earth electrode into the ground with as small as possible a driving force, it is possible according to the invention that at least the lower part thereof is ribbon-shaped and is curved in such a way that it grips around the lower part of a rod inserted in a driven head, whereas at least one clamping spiral clampingly grips around this lower part of the earth electrode. As the rod and the earth electrode are provided with their ends in the driven head, this driven head has no enlarging protruding parts which might increase the resistance against its being driven into the ground.

The invention will be explained in the following with reference to the drawing, in which, by means of example, some embodiments of the device according to the invention are shown schematically.

Figure 2:
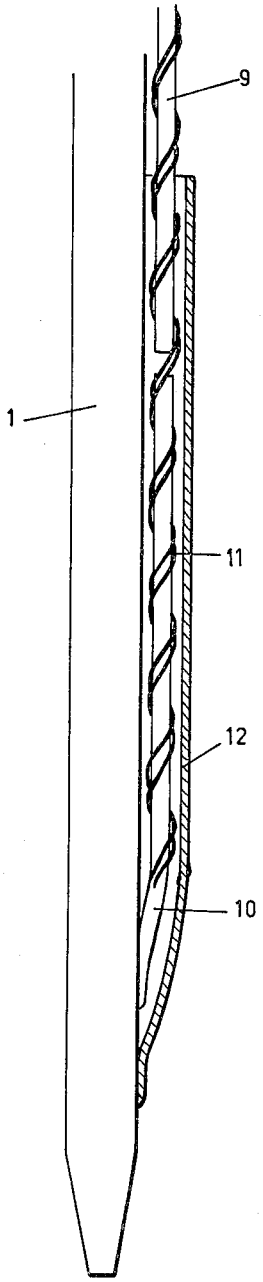
Figure 3:
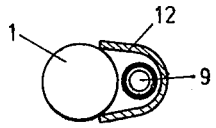
Figure 4:
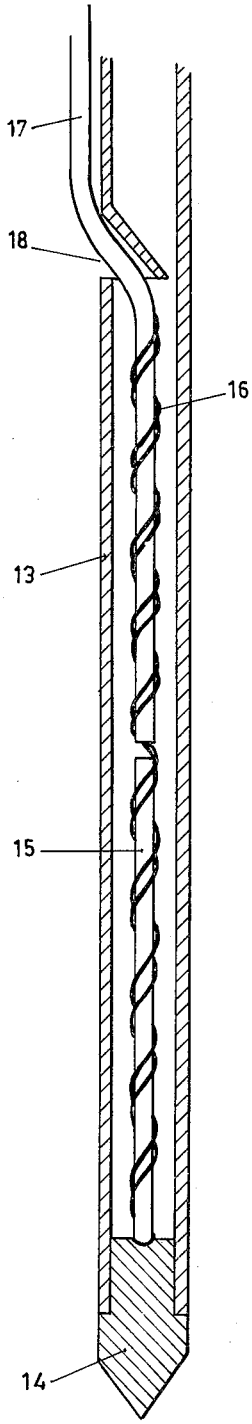
Figure 5:
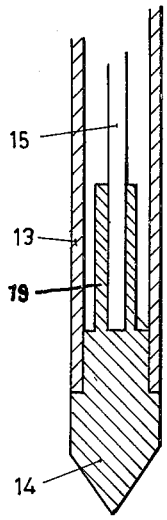
Figure 6:
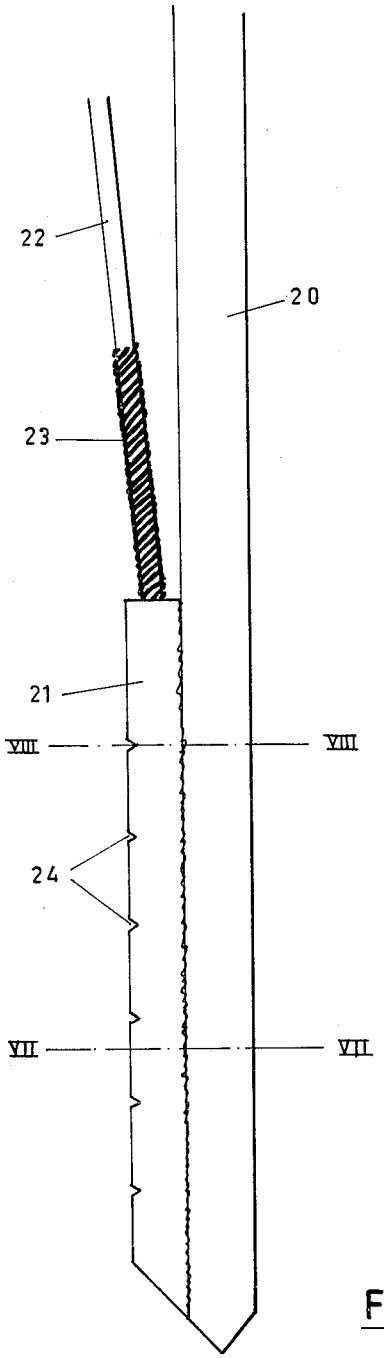
Figure 7:
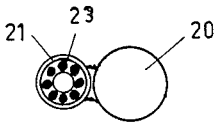
Figure 8:
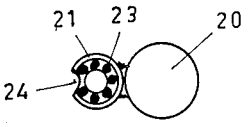
Figure 9:
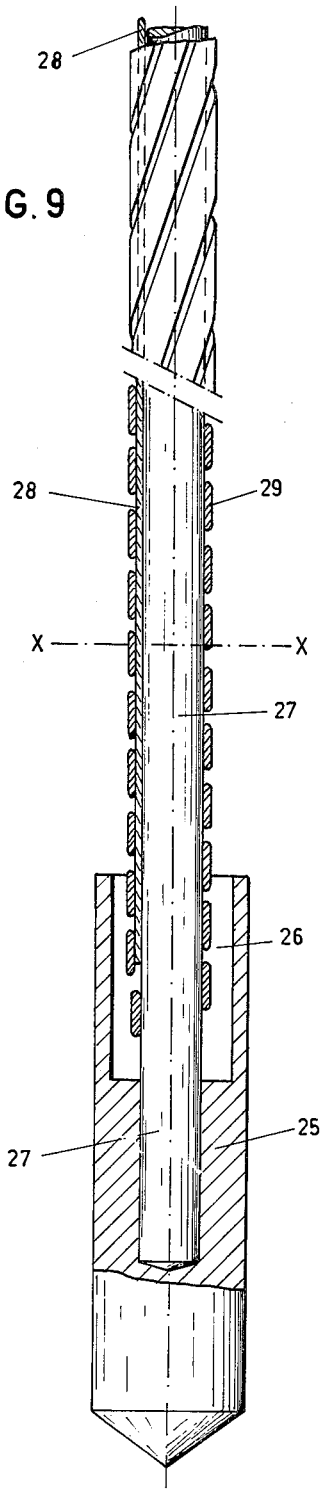
Figure 10:
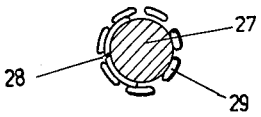

In the drawing:

FIG. 1 gives a lateral view of a first embodiment of the device according to the invention, FIG. 2 gives a lateral view of a second embodiment, FIG. 3 shows, at an enlarged scale, a cross section of the device according to FIG. 2, FIGS. 4 and 5 show a longitudinal section of a part of a third and a fourth embodiment, FIG. 6 gives a lateral view of a fifth embodiment, FIG. 7 shows, at an enlarged scale, a cross section along the line VII—VII of the embodiment shown in FIG. 6, FIG. 8 shows, at an enlarged scale, a cross section along the line VIII—VIII of the embodiment shown in FIG. 6, FIG. 9 shows a longitudinal section of a sixth embodiment, FIG. 10 shows a cross section along the line X—X of FIG. 9.

FIG. 1 shows the lower part 1 of the part indicated with interrupted lines of a rod 2, which lower part 1 is provided with a pin 3, which is provided in a detachable way in a receiving space 4 of the rod 2. In the lower part 1 is provided a hole 5, through which have been put two juxtaposed wires 6,7 in such a way that they protrude at both sides from the hole 5. Connecting slots 8 are provided in the lower part 1 at both ends of the hole 5. The parts of the wires 6,7 protruding from the hole 5 lie in slots. The parts of the wires 6,7 protruding at both sides from the hole 5 and lying above the slots 8 subsequently grip helically arond the lower end of a partially shown earth electrode 9, the pitch of the helically wound clamping wires being greater than the diameter of the earth electrode. This pitch may be for times or more the diameter of the earth electrode. The windings of the two wire sections around the end part of the earth electrode 9 are wound in the same direction and are provided clampingly on this end part of the earth electrode.

The part of the rod above the lower part 1 has been drawn in phantom lines as having a solid cross-section in FIG. 1, but it will be obvious that this part 2 may also be hollow.

The above-described device works as follows:

After the helical parts, which protrude from the hole 5 in the lower part 1, of the clamping wires 6,7 have been placed around the lower part of the earth electrode 9, the lower part 1 can be driven into the ground. For this purpose, a part 2 of the rod consisting of a number of parts is placed on this part 1 and is driven into the ground e.g. by means of an electric hammer.

The wires 6 and 7 then clamp more tightly around the lower part of the earth electrode 9, so that this earth electrode is pulled into the ground. When the part placed on the lower part 1 of the rod has been driven into the ground, a new part is placed on this part of the rod, which is also driven into the ground, so that the earth electrode is pulled further into the ground. This operation is repeated until the earth electrode is far enough in the ground. Also the earth electrode may consist of a number of sections coupled to each other.

FIGS. 2 and 3 schematically show an embodiment of the device, in which, e.g. by means of welding, a rod 10 is secured parallel to the lower part 1 of the rod. A helically wound wire 11 grips clampingly around the upper part of this rod 10 and also grips clampingly arond the lower part of an earth electrode 9. In order to prevent the clamping wire 11 from rolling up when the earth electrode is brought into the ground, so that the clamping force exerted on the earth electrode would be too small, a screen 12 with the shape of a half tube, which is closed at its lower end and which is welded or otherwise secured to the lower part 1 of the rod, is provided arond the rod 10, the clamping wire 11 and the lower end of the earth electrode 9.

In the embodiment of the invention according to FIG. 4, the lower part of the rod consists of a tube 13, which is closed at its under end by a plug 14 with a point. A rod 15 is welded to the upper side of this plug 14. A helically wound wire 16 grips with its lower part around the upper part of the rod 15, with its upper part around the lower part of the earth electrode 17, which is provided in the tubular lower part. This lower part of the earth electrode 17 has been brought into the tubular lower part of the rod through a hole 18 in the wall of the tubular lower part. This tube-wall is dented inwards, so that the earth electrode does not come into contact with sharp edges of the tube-wall.

The embodiment of FIG. 5 only distingushes itself from the one according to FIG. 4, in that the plug 14 is provided with a tubular part 19, in which is received an end of a steel rod 15, which, e.g. by means of rolling or swaging, is secured firmly to the plug 14.

FIGS. 6–8 show a favourable embodiment of the device according to the invention in which a tube section 21 is secured to the rod 20 by means of welding.

In this tube section 21 is provided the lower end of an earth electrode 22, which is provided with a helically wound clamping wire 23. By dents 24 in the wall of the tube section 21, the lower end of the earth electrode 22 with the lamping wire is connected firmly with the rod.

The embodiment shown in FIGS. 9 and 10 has a head 25, which has a hole 26, of which the lower part has a smaller cross section than the upper part. The lower part has a diameter which is preferably smaller than the diameter of the rod 27, whereas the upper part of the hole 26 has a diameter which is so much greater than that of the rod, that the lower end of the ribbon-shaped earth electrode 28 and the lower end of the clamping spirals 29 can be brought into this upper part of the hole. The lower part of the earth electrode 28 and possibly also the lower end of the clamping spiral(s) can be secured to the lower part of the rod 27 by means of welding, soldering or clamping of the wall of hole 26 against the lower end of the or each spiral.

It will be obvious that the invention is not restricted to the embodiments shown in the attached drawing and described in the above, but that these can be modified in numerous ways without departing from the scope of the invention as laid down in the claims. It is possible e.g. to provide a powder which increases the friction between the earth electrode rod 9 and the clamping wire placed thereon, such as aluminium oxide, at both sides of this earth electrode 9.

By using two or more juxtaposed clamping wires, the contact surface of the clamping wire with the earth electrode rod 9 may have any desired size, so that the forces exerted per surface unit by the clamping wires on the earth electrode rod do not become too great.

The or each clamping wire can be placed on the earth electrode manually in a simple way.

I claim:

1. An earth ground assembly comprising an earth electrode, a rod which may be driven into the ground, and at least one helically wound clamping wire surrounding the lower end portion of said earth electrode and being secured at its lower end portion to the lower end portion of the rod, said lower end portion of the rod having a tube-like portion surrounding at least the lower end portion of the helically wound clamping wire, said helically wound clamping wire having a pitch greater than the diameter of the space surrounded by the windings of the helically wound clamping wire.

2. An earth ground assembly according to claim 1, characterized in that the tube-like portion is secured to the rod, the lower end portion of the earth electrode surrounded by the helically wound clamping wire being secured in said tube-like portion by means of indentations in the wall of said tube-like portion.

3. An earth ground assembly according to claim 1, characterized in that the earth electrode consists of a bent ribbon-shaped strip surrounding at least the lower part of the rod, the helically wound clamping wire surrounding the said ribbon-shaped strip, the lower end portion of the rod being secured in the tube-like portion surronding the lower end portion of the helically wound clamping wire.

* * * * *